US005088692A

United States Patent [19]

Weiler

[11] Patent Number: 5,088,692

[45] Date of Patent: Feb. 18, 1992

[54] HEAVY DUTY STAPLE REMOVER

[76] Inventor: Raywood C. Weiler, 178 Zacharia Dr., Cathedral City, Calif. 92234

[21] Appl. No.: 707,273

[22] Filed: May 24, 1991

Related U.S. Application Data

[63] Continuation of Ser. No. 577,200, Sep. 4, 1990, abandoned.

[51] Int. Cl.[5] ..... B25C 11/00

[52] U.S. Cl. ..... 254/28

[58] Field of Search ..... 254/28; 81/415, 416, 81/419; 128/321, 323; 30/341

[56] References Cited

U.S. PATENT DOCUMENTS

| | | | |
|---|---|---|---|
| 2,202,984 | 6/1940 | Drypolcher | 254/28 |
| 2,215,662 | 10/1939 | De Generes . | |
| 2,470,726 | 11/1945 | Schafroth et al. . | |
| 2,481,647 | 9/1949 | De Generes . | |
| 2,563,227 | 8/1951 | Emery . | |
| 3,310,288 | 5/1965 | Berry . | |
| 4,026,520 | 5/1977 | Rothfuss et al. | 254/28 |
| 4,685,960 | 8/1987 | Thornton | 254/28 |
| 4,805,876 | 2/1989 | Blake et al. | 254/28 |

*Primary Examiner*—Robert C. Watson

*Attorney, Agent, or Firm*—Wood, Phillips, Mason, Rectenwald & Vansanten

[57] ABSTRACT

A heavy duty staple remover 10 for disengaging embedded staples 30 having a concealed back surface 34 and an exposed back surface 32 comprises a handle 12 having a working end 40 and a manipulating end 42 pivotally connected to the handle 12 proximate to their respective working ends. A pair of generally parallel elongate spaced apart anvils 26 are integral with the working end 18 of the handle 12. The anvils 26 being spaced apart to engage substantially the lateral extremes of the concealed back surface 34 of an embedded staple 30. A tongue 42 adapted to engage the exposed back surface 32 of an embedded staple 30 is integral with the working end 40 of the lever 14. When the handle 12 and the lever 14 are in their normal position, the tongue 42 is disposed between the anvils 26 above a plane formed by the anvils 26, but the tongue 42 pivots between the anvils 26 and through the plane formed by the anvils 26 when the lever 14 is pivoted toward the handle 12 to remove a staple.

17 Claims, 1 Drawing Sheet

HEAVY DUTY STAPLE REMOVER

This application is a continuation of application Ser. No. 577,200, filed Sept. 4, 1990 now abandoned.

BACKGROUND OF THE INVENTION

1. Technical Field

The present invention is directed toward staple removers and, more particularly, toward a heavy duty staple remover for removing embedded packaging staples.

2. Background Art

Staple removers for removing embedded staples from packaging materials are known in the art. They generally involve a pliers like structure wherein a tongue or anvils are inserted under the concealed back surface of an embedded staple and handles or levers connected thereto are drawn together. In this manner the tongue and anvils are caused to act cooperatively to remove the staple.

More specifically, Schafroth et al. U.S. Pat. No. 2,470,726 discloses a staple remover which comprises a flat base plate with an anvil at one end. A U-shaped handle straddles the flat base plate proximate to the open end thereof with the handle being pivotally connected to the edges of the flat base plate proximate to the anvil. At the open end of the U-shaped handle are short staple hooks disposed upon either side of the anvil. A staple is removed by placing the anvil over the exposed back portion of a staple while the staple hooks are being inserted under the concealed back portion of the staple. The handle is then depressed relative to the flat base plate and the staple hooks act in opposition to the bottom surface of the anvil to withdraw the embedded leg portions of the staple.

A staple remover according to U.S. Pat. No. 2,470,726 is difficult to operate because the shape of the handle makes it difficult to insert the staple hooks under the concealed back portion of an embedded staple. In addition, the tiny staple hooks may easily slip out from under a staple in a staple removal operation. The staple hooks may also be easily damaged and/or broken. Moreover, considerable pressure must be exerted on the handle when removing a staple because of the flat, wide structure of the anvil. Finally, packaging materials or fragile contents may be damaged in a staple removal operations using this device because of the force placed on the top of the package when the handle is depressed.

A staple remover according to U.S. Pat. Nos. 2,215,662 and 2,481,647 issued to De Generes comprises a first tongue defining a periphery surrounding a second tongue. The first tongue is attached to a handle and the second tongue is attached to a lever. Staples are removed by inserting both tongues under the concealed back surface of the embedded staple and then squeezing the lever towards the handle. This causes the second tongue to rise relative to the first and thereby pull the staple out by the force exerted upon the concealed back surface of the staple.

A stapler remover according to U.S. Pat. Nos. 2,215,662 and 2,481,647 is difficult to manufacture, in part because the handle and the lever must be spring biased to keep the first tongue properly aligned relative to the second tongue when the tongues are inserted under the concealed back surface of an embedded staple. Also, the structure is not always effective in removing staples because when the second tongue is lifted by the action of drawing the lever towards the handle, staples may bend around the second tongue instead of being drawn from the underlying packaging material.

U.S. Pat. No. 4,026,520 issued to Rothfuss et al. and U.S. Pat. No. 4,685,460 issued to Thornton pertain to surgical staple removers. Both disclosures define structures unsuitable for use in removing heavy duty staples from packaging materials. In addition, both structures would be difficult to insert under the concealed back surface of an embedded staple. Finally, both structures are difficult and expensive to manufacture which would make them especially unsuitable for heavy duty staple removing applications.

The present invention is directed toward overcoming one or more of the problems discussed above and achieving one or more of the resulting objects.

SUMMARY OF THE INVENTION

An object of the invention is to provide a heavy duty staple remover that may readily be grasped and inserted under the concealed back surface of an embedded staple.

A further object of the invention is to provide a heavy duty staple remover that may be driven under the concealed back surface of an embedded staple without discomfort to the user.

Still another object of the invention is to provide a heavy duty staple remover that will securely remain inserted under and grasp the back of an embedded staple throughout the staple removing operation.

Finally, it is an object of the invention to provide a heavy duty staple remover which is easy and inexpensive to manufacture in a most highly effective manner.

In one aspect of the present invention a heavy duty staple remover for disengaging an embedded staple having a concealed back surface and an exposed back surface comprises a handle having a working end and a manipulating end and a lever also having a working end and a manipulating end. The handle and the lever are pivotally connected proximate to their respective working ends. A pair of generally parallel elongate spaced apart anvils are integral with the working end of the handle. The anvils are spaced apart to engage substantially the lateral extremes of the concealed back surface of the embedded staple. A tongue adapted to engage the exposed back surface of the embedded staple is integral with the working end of the lever. When the handle and the lever are in their normal position, the tongue is disposed between the anvils above a plane formed by the anvils, but the tongue pivots between the anvils and through the plane formed by the anvils when the lever is drawn toward the handle to remove the embedded staple.

In another aspect of the invention a driving surface may be integral with the manipulating end of the handle. The anvils may be forcibly inserted under the concealed back surface of an embedded staple by the user pushing against the driving surface with the palm of his hand and, most advantageously, a cushion having a non-slip surface may be associated with the driving surface for comfort and safety. In yet another aspect of the present invention, the tongue and lever may be integrally formed from a round metal rod.

Other objects, advantages and features of the present invention will become apparent from a consideration of the following specification taken in conjunction with the accompanying drawings.

DETAILED DESCRIPTION OF THE PREFERRED EMBODIMENT

Figure 1:
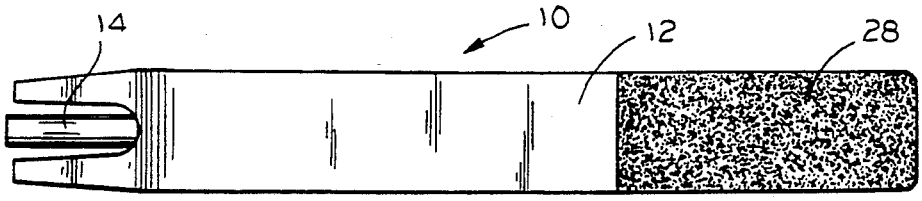
FIG. 1 is a top plan view of a heavy duty staple remover according to the invention.
Figure 2:
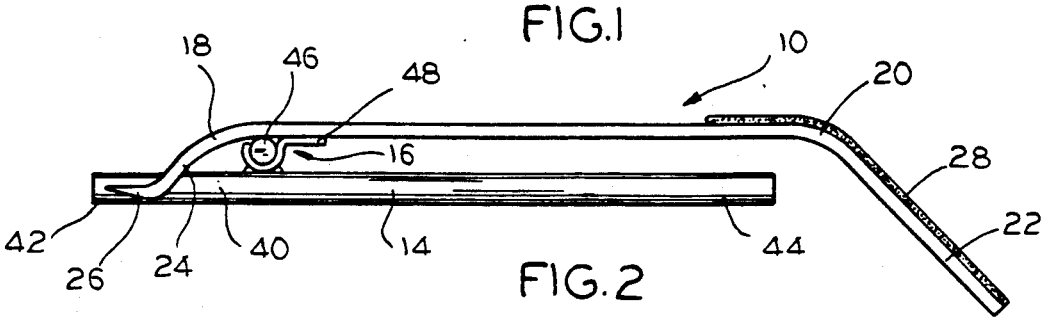
FIG. 2 is a side elevational view of the heavy duty staple remover illustrated in FIG. 1.

With reference to FIGS. 1 and 2, a heavy duty staple remover 10 comprises a handle 12 joined to a lever 14 by a pivotal connecting means 16. The handle 12 has a working end 18 and a manipulating end 20 having a driving surface 22 integral therewith. As seen most clearly in FIG. 3, the working end 18 of the handle 12 includes a pair of parallel spaced apart supports 24

Figure 3:
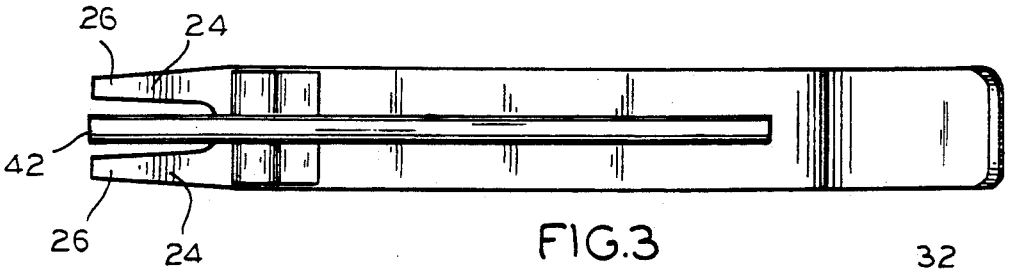
FIG. 3 is a bottom plan view of the heavy duty staple remover illustrated in FIG. 1.

With further reference to FIG. 3, the free ends of the generally parallel supports 24 comprise generally parallel spaced apart anvils 26. As best shown in FIG. 2, the anvils 26 are tapered as they extend away from the generally parallel supports 24.

As best illustrated in FIG. 2, the driving surface 22 descends from the manipulating end of the handle 20 at approximately a 45° angle. The exact angle of descent is not critical for the successful use of the device However, the angle should be sufficient for the driving surface 22 to be easily grasped and readily engaged by a user's palm when the staple remover 10 is driven generally parallel to the anvils 26 in a staple removal operation. Similarly, the parallel supports 24 descend from the manipulating end 18 of the handle 12 at an angle that may be approximately 45°. As shown, the anvils 26 are integral with the parallel supports 24 such that the top surfaces of the anvils 26 lie in a plane substantially parallel to the plane formed by the top surface of the handle 12.

Preferably, the body 12, the driving surface 22, the parallel supports 24 and the anvils 26 are integrally formed from a single piece of heavy gauge sheet metal. The sheet metal should be of a sufficient gauge to avoid deformation even when subjected to considerable stress and, for the purpose of illustration and not of limitation, an 11 gauge steel has been found to yield acceptable results. The handle 12 and the driving surface 22 may be of any width which may be easily grasped and will not injure the palm of the hand when force is exerted against the driving surface 22 by the palm of the users hand in a staple removal operation. While one inch width has been found to yield acceptable results, it will be readily appreciated by one skilled in the art that other widths may function equally well.

In the preferred embodiment, a cushion or pad 28 is attached to the top of the driving surface 22. The cushion 28 may be made of any resiliently deformable material with both rubber and high-density foam rubber having been found to yield acceptable results. Preferably, the cushion or pad 28 has a non-slip surface regardless of the material from which it is formed.

Figure 4:
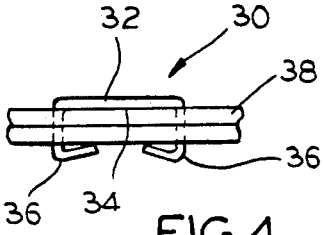
FIG. 4 is a cut-away front view illustrating a staple embedded in packaging material.

As will be appreciated, FIG. 4 illustrates an embedded staple 30. The embedded staple 30 comprises an exposed back surface 32, a concealed back surface 34 and two legs 36. In the illustration, staple 30 is embedded in a packaging material 38.

Figure 5:
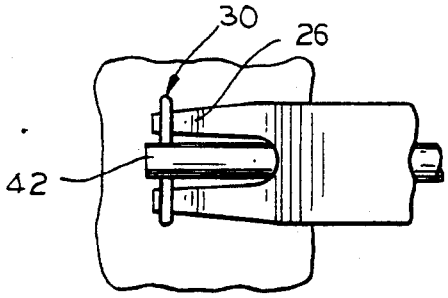
FIG. 5 is a top plan view illustrating a first step in using the heavy duty staple of FIG. 1.
Figure 6:
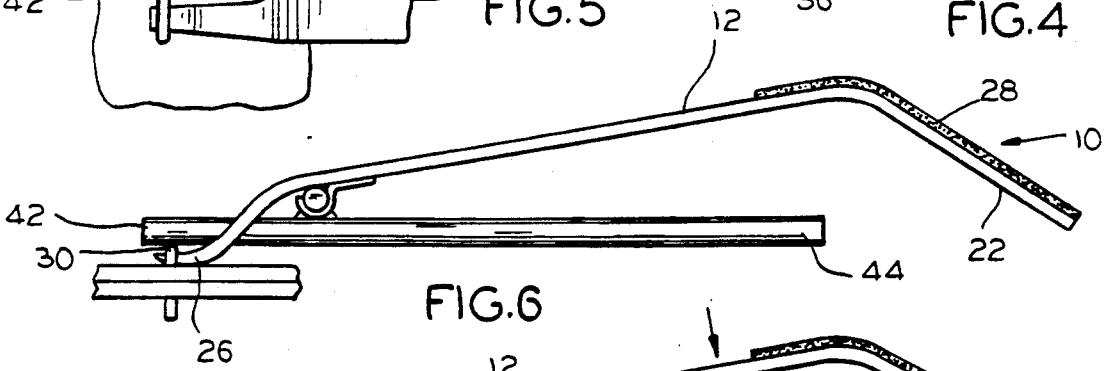
FIG. 6 is a side elevational view also illustrating the first step in using the heavy duty staple remover of FIG. 1.
Figure 7:
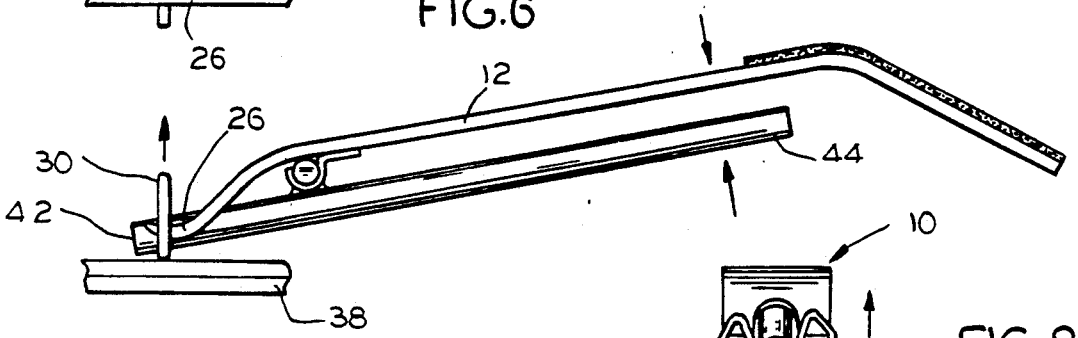
FIG. 7 is a side elevational view illustrating a second step in using the heavy duty staple of FIG. 1.

With reference to FIGS. 3, 5 and 6, the anvils 26 are tapered for handling insertion between the concealed back surface 34 of the embedded staple 30 and the packaging material 38. The anvils 26 are also spaced apart such that when inserted under the concealed back surface 34 of the embedded staple 30, they engage substantially the lateral extremes of the concealed back surface 34. Of course, the distance the anvils are spaced apart depends upon the length of the concealed back surface 34 of the embedded staple 30.

Referring once again to FIG. 2, the lever 14 comprises a working end 40 having an integral tongue portion 42 and a manipulating end 44. As best seen in FIG. 3, the tongue 42 is disposed between the generally parallel supports 24 and the anvils 26. As illustrated in FIG. 6, when the heavy duty staple remover 10 is in a normal position, the tongue 42 lies above the plane formed by the anvils 26.

In the preferred embodiment, the lever 14, including the tongue 42 and the manipulating end 44, are all integrally formed from a single round steel bar. The lever or bar 14 should be of sufficient diameter so as to be able to bend the exposed back surface 32 of an embedded staple 30 without suffering deformation. In practice, a diameter of 5/16 in. has been found to yield acceptable results, although other diameters may function equally as well.

Referring to FIG. 2, the pivotable connecting means 16 preferably comprises a metal rod 46 connected perpendicularly to the lever 14. The metal rod 46 is preferably located proximate to the working end 40 of the lever or bar 14 and a securing plate 48 is connected to the under side of the handle 12 proximate its working end 18. As shown, the metal securing plate 48 surrounds the metal rod 46 in an annular manner to form the pivotal connecting means 16.

In the preferred embodiment, the metal rod 46 is welded to the lever 14 and the metal securing plate 48 is welded to the underside of the handle 12. The metal rod 46 and the metal securing plate 48 may be of any thickness that can operate without deformation. By way of example and not limitation, ¼ in. diameter steel rod 46 and a 16 gauge steel securing plate 48 have been found to yield acceptable results.

The operation of the heavy duty staple remover 10 according to this invention is best described by reference to FIGS. 4 through 8. To remove the embedded staple 30 the anvils 26 are forcibly inserted under the concealed back surface 34 by a user driving the palm of his hand against the driving surface 22. The non-slip cushion 28 permits the anvils 26 to be forcibly inserted under the concealed back surface 34 of an embedded staple 30 without discomfort to the user's palm. In addition, the non-slip cushion 28 minimizes the risk of the user's hand slipping, and thereby reduces the risk of injury in a staple removal operation.

As seen in FIGS. 5 and 6, the anvils 26 are readily insertable under the concealed back surface 34 of the embedded staple 30 because of their tapered contour.

As illustrated in FIG. 6, the tongue 42 lies above the exposed back surface 32 of the embedded staple 30 when the heavy duty staple remover 10 is in its normal position When the manipulating end 44 of the lever 14 is drawn towards the bottom surface of the handle 12, the handle 12 and the lever 14 undergo relative pivotal movement about the pivotable connecting means 16 and the anvils 26 act in opposition to the rounded tongue 42, thus forcing the legs 36 of the embedded staple 30 to be withdrawn from the packaging material 38. Because of the round shape of the tongue 42, the tongue 42 easily deforms the exposed back surface 40 of the embedded staple 30.

Figure 8:
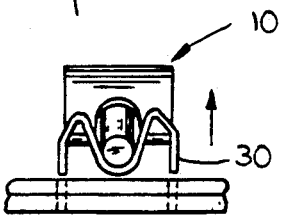
FIG. 8 is a front elevational view of the staple remover according to the present invention illustrating staple deformation upon removal.

As best seen in FIG. 8, the embedded legs 36 of the embedded staple 30 are straightened during the staple removing operation. Thus, the legs 36 may be withdrawn through substantially the same holes which they created when inserted into the packaging material 38. Due to the length of the anvils 26, the concealed back surface 34 of the embedded staple 30 will not slip off the anvils 26 in a staple removal operation.

In some instances the embedded staple 30 may not be readily and entirely withdrawn from the packaging material 38. In such instances, the embedded staple 30 is nevertheless securely fastened between the anvils 26 and the tongue 42. Therefore, the heavy duty staple remover 10 may be twisted and pulled to readily remove the embedded staple 30.

The heavy duty staple remover 10 according to this invention may be easily grasped and manipulated utilizing the driving surface 22 and the handle 12. The anvils 26 may be readily forcibly inserted under the concealed back surface 34 of an embedded staple 30 without discomfort to the palm of the users hand. Once the anvils 26 are inserted under the concealed back surface 34 of the embedded staple 30, they will remain thereunder during the deformation of the embedded staple 30 due to their length, and the embedded staple 30 will be readily deformed by the cooperation of the anvils 26 and the round tongue 42. Thus, embedded staples 30 may be quickly and easily removed from packaging material 38 without harming the packaging material 38 and without discomfort to the users hand with the heavy duty staple remover 10 which is in accordance with this invention both easy and inexpensive to build.

While in the foregoing there has been set forth a preferred embodiment of the invention, it will be readily appreciated that the details herein given may be varied by those skilled in the art without departing from the true spirit and scope of the appended claims.

I claim:

1. A staple remover for disengaging embedded staples having a concealed back surface and an exposed back surface, comprising:

a handle having a working end and a manipulating end;

a lever having a working end and a manipulating end;

means pivotally joining the handle and the lever proximate to their respective working ends;

a pair of generally parallel elongate spaced apart anvils connected to the working end of the handle, the anvils being spaced apart to engage substantially the lateral extremes of the concealed back surface of an embedded staple;

a rod-like tongue having a rounded surface adapted to engage the exposed back surface of a staple integral with the working end of the lever;

the tongue being disposed between the anvils and substantially parallel thereto, the tongue, in its normal position, being disposed above a plane formed by the anvils, the tongue being pivotable through the plane formed by the anvils when the lever is drawn towards the handle.

2. The staple remover of claim 1 wherein a driving surface is connected to the manipulating end of the handle whereby the anvils may be forcibly inserted under the concealed back surface of an embedded staple by a user pushing against the driving surface with the palm of his hand.

3. The staple remover of claim 2 wherein the handle, the anvils and driving surface are integrally formed.

4. The staple remover of claim 2 wherein a means for cushioning is attached to the driving surface.

5. The staple remover of claim 2 wherein a non-slip surface is associated with the driving surface.

6. The staple remover of claim 1 wherein the tongue and the lever are integrally formed from a round rod.

7. The staple remover of claim 1 wherein the spaced apart anvils taper as they extend away from the working end of the handle.

8. A staple remover for disengaging embedded staples having a concealed back surface and an exposed back surface comprising:

an integrally formed flat elongate handle having a working end, a manipulating end, and a driving surface integrally associated with the manipulating end;

an integrally formed lever having a working end, a manipulating end and a round tongue integrally associated with the working end;

a pair of generally parallel elongate spaced apart anvils integrally associated with and tapered away from the working end of the handle, the anvils being spaced apart to engage substantially the lateral extremes of the concealed back surface of an embedded staple;

means pivotally joining the handle and the lever approximate to their respective working ends;

the tongue being disposed between the anvils and substantially parallel thereto, the tongue, in its normal position, being disposed above a plane formed by the anvils, the tongue being pivotable through the plane formed by the anvils;

the tongue being adapted to engage the exposed back surface of a staple when the lever is drawn toward the handle.

9. A staple remover for disengaging embedded staples having a concealed back surface and an exposed back surface, comprising:

a flat elongate handle having first, second and third sections;

the second section of the handle being of an elongate rectangular configuration with first and second opposing ends, the first section of the handle being integral with the first end of the second section, the third section of the handle being integral with the second end of the second section, the third section of the handle descending from the second section to form a driving surface, the first section of the handle comprising spaced apart parallel supports descending from the second section;

a pair of parallel elongate spaced apart, anvils integral with the parallel supports of the first section, the anvils being spaced to engage substantially the lateral extremes of the concealed back surface of an embedded staple;

a lever having a working end and a manipulating end;

means pivotably joining the handle and the lever proximate to the working end of the lever and the first end of the second section of the handle;

a rod-like tongue having a rounded surface integral with the working end of the lever and the rounded surface of the rod-like tongue being adapted to engage the exposed back surface of a staple;

the tongue being disposed between the parallel supports and being substantially parallel to the anvils, the tongue, in its normal position, being disposed above a plane formed by the anvils and pivotable through the plane formed by the anvils when the lever is pivoted towards the handle.

10. The staple remover of claim 9 wherein a means for cushioning is attached to the driving surface.

11. The staple remover of claim 10 wherein a non-slip surface is associated with the driving surface.

12. The staple remover of claim 11 wherein the lever comprises a round rod.

13. The staple remover of claim 12 wherein the lever and the handle are formed of metal.

14. The staple remover of claim 13 wherein the first, second and third sections of the handle and the anvils are integrally formed.

15. The staple remover of claim 14 wherein the tongue and the lever are integrally formed from a round rod.

16. The staple remover of claim 15 wherein the spaced apart anvils taper as they extend away from the parallel supports.

17. The staple remover of claim 16 wherein the handle and the lever are made of metal.

* * * * *